US010662034B2

(12) United States Patent
Hofmeister et al.

(10) Patent No.: US 10,662,034 B2
(45) Date of Patent: May 26, 2020

(54) CLIMBING SYSTEM FOR A CRANE

(71) Applicant: Liebherr-Werk Biberach GmbH, Biberach an der Riss (DE)

(72) Inventors: Markus Hofmeister, Bad Waldsee (DE); Andreas Hussong, Bihlafingen (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 220 days.

(21) Appl. No.: 15/551,669

(22) PCT Filed: Feb. 19, 2016

(86) PCT No.: PCT/EP2016/000292
§ 371 (c)(1),
(2) Date: Jan. 25, 2018

(87) PCT Pub. No.: WO2016/131550
PCT Pub. Date: Aug. 25, 2016

(65) Prior Publication Data

US 2018/0155161 A1 Jun. 7, 2018

(30) Foreign Application Priority Data

Feb. 20, 2015 (DE) ..... 10 2015 002 237

(51) Int. Cl.
*B66C 23/28* (2006.01)

(52) U.S. Cl.
CPC ..... *B66C 23/283* (2013.01)

(58) Field of Classification Search
CPC ..... B66C 23/28–286
See application file for complete search history.

(56) References Cited

U.S. PATENT DOCUMENTS 3,302,801 A * 2/1967 Poroli ..... B66C 19/02 212/176
2003/0213765 A1* 11/2003 St-Germain ..... B66B 7/027 212/294
2007/0119331 A1* 5/2007 Korchagin ..... A62B 1/02 104/307

FOREIGN PATENT DOCUMENTS

DE 20 2005 009236 U 9/2006
JP H08-133674 A 5/1996
WO 2014/048516 A1 4/2014

* cited by examiner

*Primary Examiner* — Sang K Kim
*Assistant Examiner* — Nathaniel L Adams
(74) *Attorney, Agent, or Firm* — Dilworth & Barrese, LLP

(57) ABSTRACT

The invention relates to a climbing system (1) for a crane. The system comprises a climbing apparatus (2) for inserting a mast section (3) or for removing a mast section (3) from a tower structure (4) of a crane, and a control unit (5) for controlling the climbing apparatus (2). The system is furthermore characterized in that the system comprises a first sensor (51) for monitoring a state of a connection means of the climbing apparatus (2) and/or the tower structure (4), wherein the first sensor (51) is connected to the control unit (5). A climbing process of a crane can thus be simplified and the safety of the climbing process can be increased.

16 Claims, 4 Drawing Sheets

CLIMBING SYSTEM FOR A CRANE

BACKGROUND OF THE INVENTION

The present invention relates to a climbing system for a crane.

In the context of cranes, the term "climbing" describes the inserting process of mast elements into a crane tower in order to elevate a crane to a desired clamp height. To this end, a climbing apparatus moveably connected to the tower structure is provided, which typically surrounds the crane and features an opening at one of its sides through which opening a mast section (mast element) can be inserted into the tower structure or be removed therefrom.

In the state of the art, the climbing apparatus is, among others, called climbing lift, climbing elevator, climbing platform, or telescope slide. This, however, always refers to a moveable structure linked to the crane tower designed to insert a mast section into a tower section respectively removing it from the latter.

In general, climbing is effected with the crane upper section fully mounted, which typically comprises the main jib, the counter jib, the counter ballast, the crane cab, and the turntable. The climbing apparatus is arranged beneath and connected to the crane upper section such that it can lift the crane upper section. A mast section can thus be inserted into the tower structure or removed from the tower structure in order to elevate the crane upper section to a desired height level.

When climbing a crane, the portion of a tower structure above the climbing apparatus is lifted by means of a hoisting device and a mast section is inserted in the gap so generated. Thereby, the freshly inserted mast section is fixed to the tower structure by assemblers working on the tower structure. Due to personnel-intensive work that has to be realised in the area of the mast section to be inserted respectively to be removed, climbing a crane is laborious. What is more, the accident hazards for the personnel in charge of the climbing process is high during their effecting such climbing process.

SUMMARY OF THE INVENTION

Therefore, the object of the present invention is to simplify the climbing process of a crane and to significantly reduce the accident hazards.

This is achieved by the climbing system for a crane featuring the characteristics herein.

The system comprises a climbing apparatus for inserting a mast section into a tower structure of a crane or for removing a mast section from a tower structure of a crane as well as a control unit for controlling the climbing apparatus. The system is furthermore characterised in that it comprises a first sensor for monitoring a state of a connection means of the climbing apparatus and/or a tower structure, wherein the first sensor is connected to the control unit.

The first sensor can be an electromechanical, an inductive, a capacitive, an optical, or an ultrasonic sound sensor. Of course, the provision of several first sensors for monitoring of connection means of the climbing apparatus and/or the tower structure is also conceivable. Hereby, the first sensor can preferably detect the state of the connection means in a closed position or in an open position. Furthermore, the first sensor can advantageously also determine a torque impacting the connection means.

A crane tower comprises several stacked mast sections connected to each other. In general, the individual mast sections are connected to each other by means of studs or similar connection means.

The states of security relevant connection means, in particular screwed and/or stud joints to the climbing apparatus as well as those on the tower itself are monitored by means of the first sensor. This enables detection of faultily arranged connection means and sending a corresponding signal to the control unit. Therefore, any hazard due to a faultily arranged connection means which might endanger the sturdiness of the tower structure is detected by means of the first sensor. Thus, the connection of each freshly inserted mast section is verified by the first sensor. The sensor is connected to the control unit via a wire or a radio circuit and sends corresponding signals to the control unit relating to the state of a connection means.

According to another advantageous variation of the invention, the control unit furthermore comprises an interface for connecting it to a crane control of the crane, such that the crane and the climbing apparatus are controllable via a common control unit, preferably the control unit for controlling the climbing apparatus.

This enables a particularly safe climbing process which can be implemented with little manpower requirements. Therefore, it is possible that a mast section arranged on the bottom be lifted by a jig of the crane, the hook height of which is to be elevated, and be transferred to a climbing apparatus, whereby the control of the crane and the climbing apparatus can be realised both by means of both the crane and by means of the control unit controlling the climbing apparatus. What is more, errors which might occur due to a diverging control during the transfer of elements controlled by the crane to the climbing apparatus, will occur less often as it is possible to use a common control unit. As, in addition, control is ensured "from one source", the climbing process is simplified by the climbing system of the invention and requires less operators.

The interface for connecting it to a crane control of the crane can be executed via a wire or radio circuit. The interface, however, is configured such that the control unit can access the crane control of the crane via such interface and control the crane. Alternatively, it is also possible that the control of the climbing device is ensured via the crane control. Thus, it is ensured that the crane control and the control of the climbing apparatus can be executed by means of a common control device.

Preferably, the climbing system comprises a second sensor for detecting a mark mounted on a guiding frame of the climbing apparatus or the tower structure and enabling a conclusion as to specific properties of the tower structure, wherein the second sensor is connected to the control unit.

Is called guiding frame the exterior frame of the climbing apparatus which typically surrounds a mast section from outside and thus being connected to the latter as to be able to push the crane upper section upwards. The mark distinguishable by means of the second sensor enables a conclusion as to specific properties of the tower structure. This information is transferred to the control unit which therefore can realise a corresponding charge torque reduction during the climbing process or even during the crane operation.

Preferably, the control unit for controlling the climbing apparatus is configured to send control instructions to a carrier drive of a climbing apparatus. By means of this carrier drive, a mast section is horizontally moved into the gap created by means of the climbing apparatus. The carrier drive is also used to approximately horizontally move a mast section to be removed from the tower structure which is then let down to the bottom by means of a well-functioning crane upper section.

According to another optional, advantageous characteristic of the invention, the system furthermore comprises a third sensor for monitoring a hoisting device of the climbing apparatus, where the third sensor is connected to the control unit.

The hoisting device of the climbing apparatus lifts any and all elements of a crane arranged above it. Then, a mast section can be inserted in the gap generated by the hoisting device. It goes without saying that the hoisting device also enables lifting of the crane elements arranged above it in order to remove a mast section from the tower structure. Here, the third sensor in particular monitors the position respectively the posture of the hoisting device in order to obtain information about a possible removal respectively insertion of a mast section. Furthermore, the third sensor is connected to the control unit via a wire or radio circuit such that the information gained from the third sensor can be transferred to the control unit.

The third sensor can also be configured to detect the position of the climbing apparatus on the tower structure. Preferably, the third sensor is able to detect a supporting cleat used by the hoisting device and/or to detect faultless seat of the hoisting device on the cleat. The hoisting device is supported against at least one supporting cleat which introduces the supporting forces emitted by the hoisting device into the tower structure. Thereby, several supporting cleats vertically spaced apart from each other can be mounted on a mast section. Following insertion of a mast section, the hoisting device changes from the supporting cleat against which it is supported to a cleat device arranged on a higher level. Then, insertion of a mast section can be repeated and the crane climbs in its height.

Preferably and furthermore, the system comprises a fourth sensor for detecting the orientation and the angle of slope of the climbing apparatus and/or the crane, wherein the fourth sensor is connected to the control unit.

The fourth sensor is preferably configured to detect the precise position of the climbing device as well as the crane. Thereby, balancing of the crane is simplified. Balancing of the crane can also be effected automatically via the crane control or via the control unit. Thereby, turntable, carrier, hoisting device and jig movements are controlled automatically.

Moreover, and according to another optional characteristic of the invention, it is possible to detect all travel movements as well as all positions of mechanical components via path detection systems. Are conceivable here as mechanical components the rotation movement of the crane, the movement of the trolley of the main jig, the movement of the carrier drive of the climbing apparatus which is used in order to insert a mast section into the tower structure with a horizontal movement or to remove it from the tower structure by means of a horizontal movement, the movement initiated by the lifting unit of the hoisting device, a movement of the jig, travel of the load block of the main jig and/or a movement of the counter jig ballast.

The path detection system is implemented by means of electromechanical, inductive, capacitive, optical or by sensors based upon ultrasonic sound. Here, a combination of various sensor types is conceivable, too. The path detection system is able to detect the precise position of the mechanical components described in detail hereinabove. For example, this enables a conclusion as to the position of a mast section mounted to the carrier drive of the climbing apparatus. Preferably, this information is transferred to the control unit via a wire or radio circuit.

Preferably, the climbing apparatus comprises a fifth sensor for detecting the torque at least one point of the climbing apparatus, wherein the fifth sensor is connected to the control unit. The connection can be realised as wireless or wired. Preferably, the fifth sensor is also provided at connection means such that the torques present here can be detected.

Due to the data measured by means of the fifth sensor, automatic mounting or demounting of the tower structure is possible. Such information is sent to the control unit where they are analysed, resulting into corresponding triggering of the electrical, pneumatical, or hydraulic devices necessary to the mounting and demounting process.

According to another advantageous embodiment of the system of the invention, the latter comprises a detection system for monitoring an area between the tower structure and the climbing apparatus and an area where the mast section is inserted into the tower structure or is removed therefrom, whereby such monitoring is preferably effected by means of a light grid, laser, haulage rope, or camera system. Preferably, such detection system is connected to the control unit.

The detection system is designed to detect a potential hazardous situation in due time and to avoid it via a corresponding signal sent to the control unit. Therefore, insertion of a mast section into the tower structure shall preferably be stopped as long as the assemblers remain in the hazard zone. The control unit of the system is furthermore advantageously configured as to trigger the climbing apparatus and/or the crane such that insertion of the mast section into the tower structure or removal of the mast section from the tower section runs automatically without activating an overload state.

As any and all positions of moveable parts on the climbing apparatus are safely monitored, it is possible to automate the climbing process of the crane. Hereby, the torques present on the connection means as well as on the guiding frame of the climbing apparatus are preferably detected via sensors. Such information enables an implementation of an automated mounting as well as demounting of the connection means (in particular screwed and stud joints) by means of electrical, pneumatical and/or hydraulic devices.

Preferably, the system comprises a device for coupling and uncoupling of connection means connected to the control unit and controllable by the latter.

According to another advantageous embodiment of the invention, the system comprises an optical display element for reproducing various states of the system, wherein preferably activities to be executed are displayed, too.

The optical display element can be mounted on a control panel and display current states of the equipment as well as, depending on the situation, necessary activities via a display or via display elements. In particular, such control panel can be provided with additional symbols. Preferably, the control panel as well as the optical display elements arranged thereon are connected to the control unit of the system. Hereby, it is also possible that control elements as well as a touch-sensitive surface in a display of the control panel enable control of the control unit.

Moreover, visualisation by means of optical display elements offers diagnosis as well as error representation. This enables significant reduction of error-induced downtimes of the system as localisation of the error source is facilitated. It is also possible to represent a multitude of all data detected by means of sensors in the visualisation, thereby enabling optical representation of various process steps of the climbing process.

Preferably, the control unit is controlled via a wired remote control or via a radio remote control featuring range restrictions. This enables flexible control of the system from several spots. Moreover, the control unit comprises a positioning mode where the speed of the hoisting device can be significantly reduced such that insertion as well as demounting of connection means (screwed and stud joints) is simpler to execute.

BRIEF DESCRIPTION OF THE DRAWINGS

Hereinafter, the present invention is described in more detail by means of drawings, where.

DESCRIPTION OF THE PREFERRED EMBODIMENTS

Figure 1:
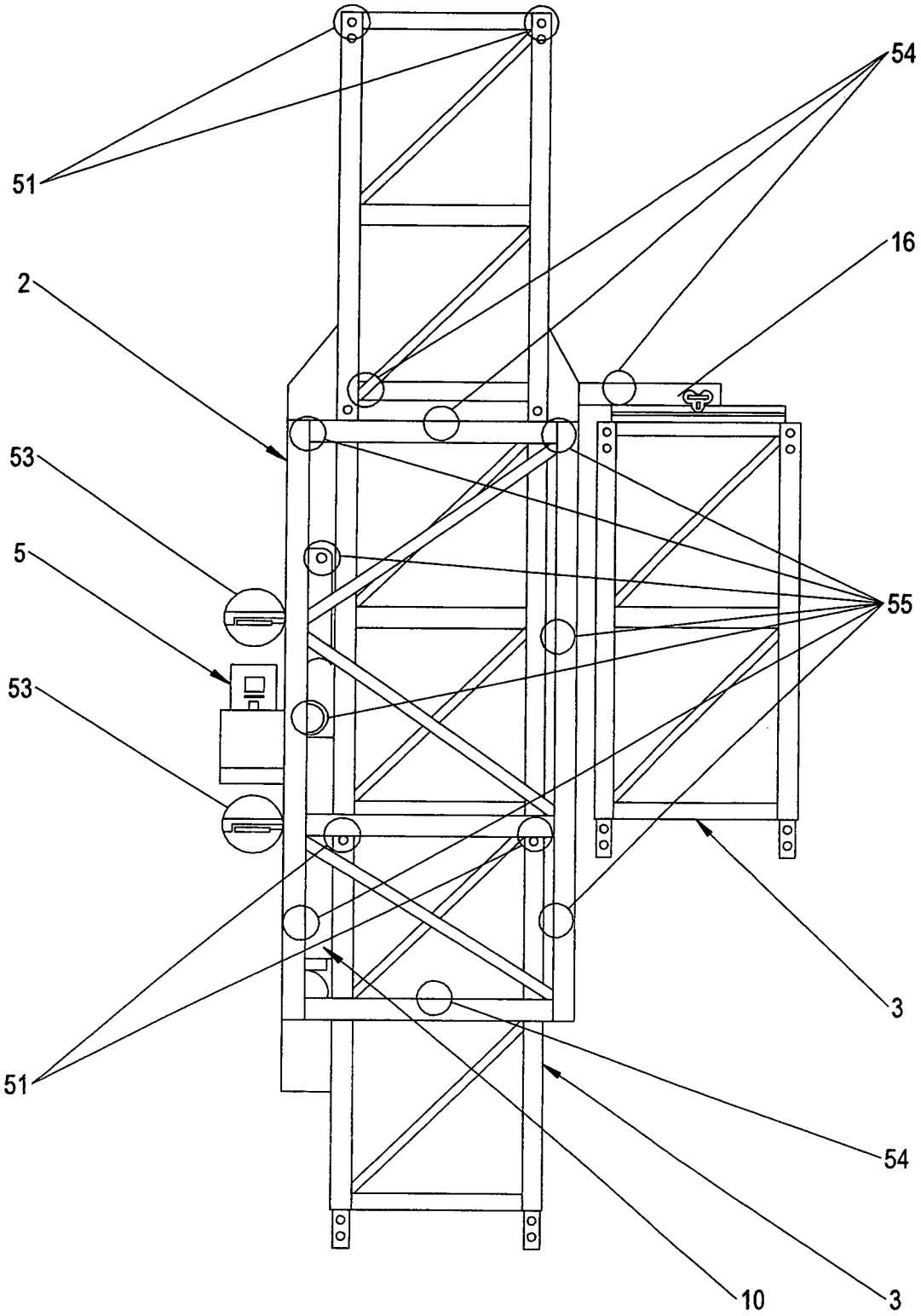
FIG. 1: shows the climbing system of the invention in a lateral view of a tower structure.

FIG. 1 shows a portion of a crane tower wherein a climbing system 1 is arranged. The climbing system comprises a climbing apparatus 2, which surrounds the tower structure 4. The climbing apparatus 2 is connected to a crane tower portion arranged above and beneath it. Moreover, it is provided with a hoisting device 10 which can push away the portion of the crane arranged above the climbing apparatus 2 upwards from the portion of the crane arranged beneath the climbing apparatus 2. Thereby, the hoisting device 10 is supported on so-called supporting cleats 14 protruding outwards on a mast section 3.

One furthermore detects a mast section 3 to be inserted which is suspended from a carrier drive 16 of the climbing apparatus 2. The carrier drive 16 essentially ensures horizontal travel of the mast section such that the latter can be introduced into a gap created by the hoisting device 10. By means of the fully mounted crane upper section, the mast section 3 is transferred to the climbing apparatus mounted in a specific height.

Moreover, a first sensor 51 monitoring a state of the connection means is provided proximate to the connection means of the various mast sections 3. Thereby, it is possible to determine whether the connection means between the various mast sections 3 are in their intended position.

Furthermore, two third sensors 53 are arranged on the guiding frame 7 of the climbing apparatus 2. These are able to determine the position of the lifting unit of the hoisting device 10 and can determine the supporting cleat 14 which is currently being used and where the hoisting devices is supported.

Two fourth sensors 51 which can determine the slope of the guiding frame 7 respectively of the tower structure 4 are positioned on the stiffeners of the guiding frame 7 arranged on its top and on its bottom.

Furthermore, several fifth sensors 55 are mounted on the guiding frame 7 and can determine a torque present on the guiding frame at their respective mounting spots. Thereby, any transgression of the admissible maximum load of the guiding frame 7 can be detected and such load can be returned into its normal state by appropriate corrective action.

Any and all sensors are connected to the control unit. The connection can be executed as a wireless or a wire-bound one. The information collected from several sensors are processed in the control unit 5 such that even automated climbing can be realised by means of the climbing system of the invention.

Figure 2:
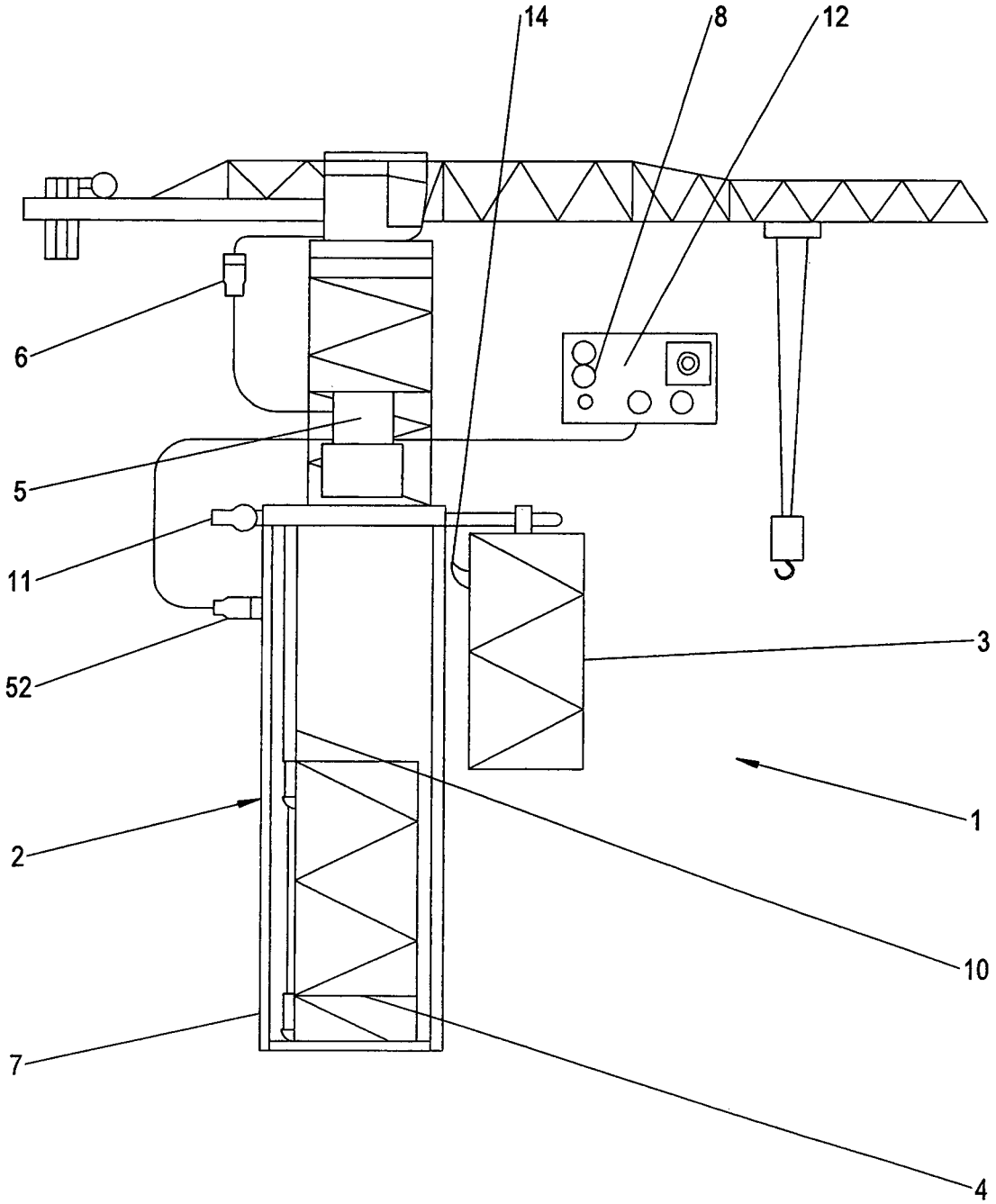
FIG. 2: shows a stylised representation of the climbing system of the invention.

FIG. 2 shows a crane featuring a climbing system 1. One distinguishes a climbing apparatus 2 arranged beneath the crane upper section as well as a mast section 3 which is retractable by means of a carrier drive into the gap created by the hoisting device 10. Thereby, the mast section 3 is suspended at a carrier drive 11 belonging to the climbing apparatus 2. In order to achieve this position, the mast section 3 is lifted from the bottom by means of the main jig of the crane and transferred to the climbing apparatus 2.

The climbing apparatus 2 is in an effective connection with the tower structure 4 and thus is supported by the latter in order to constitute an opening between the tower structure 4 as well as the crane elements arranged above the climbing apparatus 2.

Moreover, one distinguishes the control unit 5 which is connected to the control panel 12 for controlling the control unit 5. One also distinguishes the interface of the control unit 5 via which a connection is ensured to the crane control. Furthermore, the control unit features a connection to a second sensor 52 which can detect a mark positioned on the tower structure 4 or on the guiding frame of the climbing apparatus 2, whereby the control unit 5 is informed about specific properties of the tower structure 4. Thereby, it is possible to adjust the crane control to specific properties during a climbing process. For example, it is conceivable to restrict the maximum load to be lifted of the crane and/or to reduce the maximum jig length while the crane is climbing.

The interface 6 of the control unit 5 is designed for its connection to the crane control. When executing this connection, control of the crane and the climbing apparatus is possible via common control. Here, coordinated control of the crane and the climbing apparatus is possible. In this way, the control unit 5 can control the crane even without entering a control instruction. This is an advantage for example where a state diverging from the normal state is detected by means of the sensors represented in FIG. 1. In the event of a slope of the guiding frame 7 respectively the tower structure 4, a process of the counter ballast can be executed automatically in order to balance the slope of the guiding frame respectively the crane tower.

Figure 3:
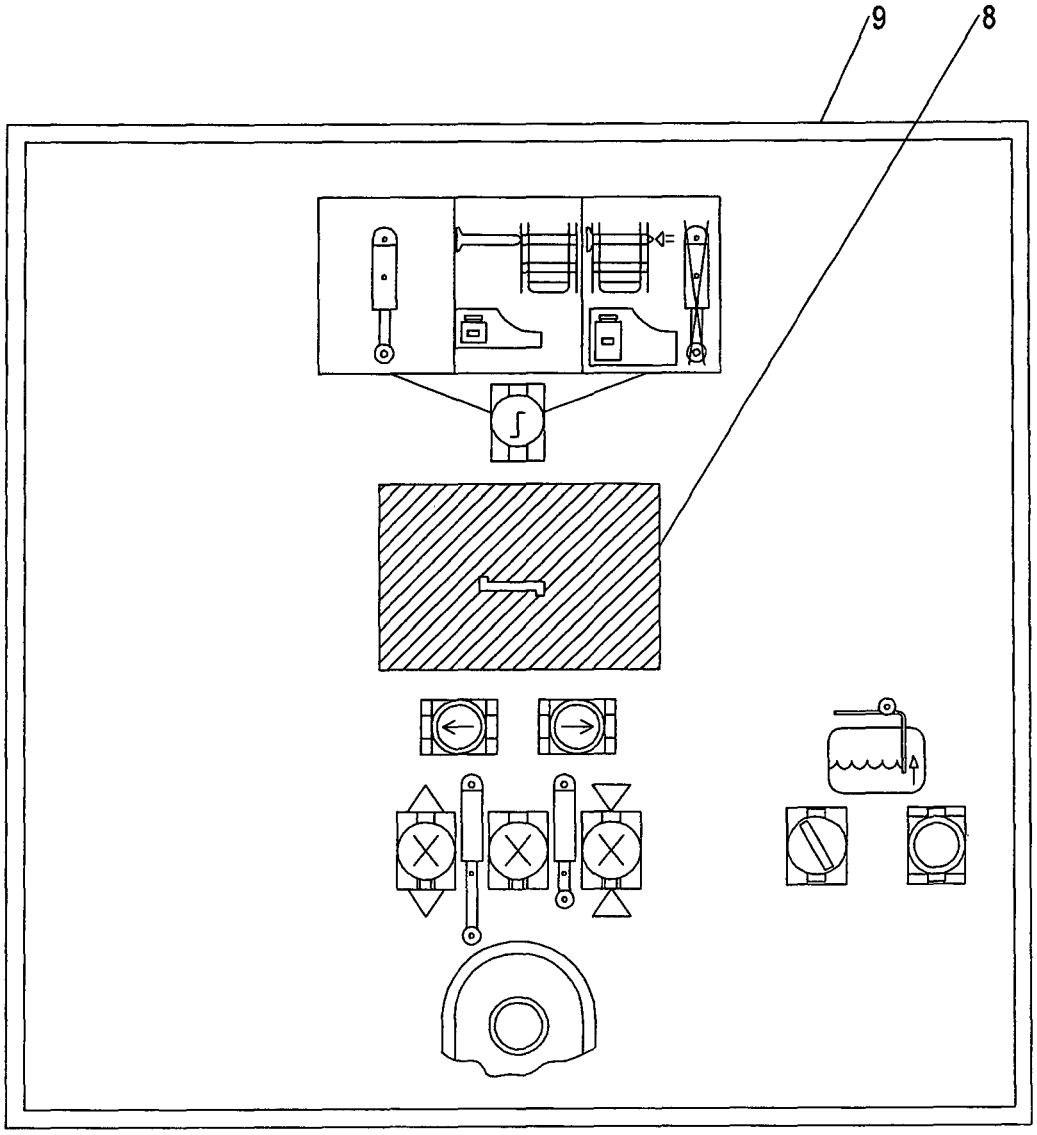
FIG. 3: shows a control panel with its optical display elements for controlling the control unit of the system of the invention, FIG. 4(*a*) shows a display of a control panel for a specific state of the climbing system, and FIG. 4(*b*) shows another display of a control panel for a specific state of the climbing system.

FIG. 3 shows a control panel 9 for the control unit 5. One distinguishes a display 8 as well the state displays and the control keys for interacting with the control unit 5, arranged beside the display 8.

Figure 4:
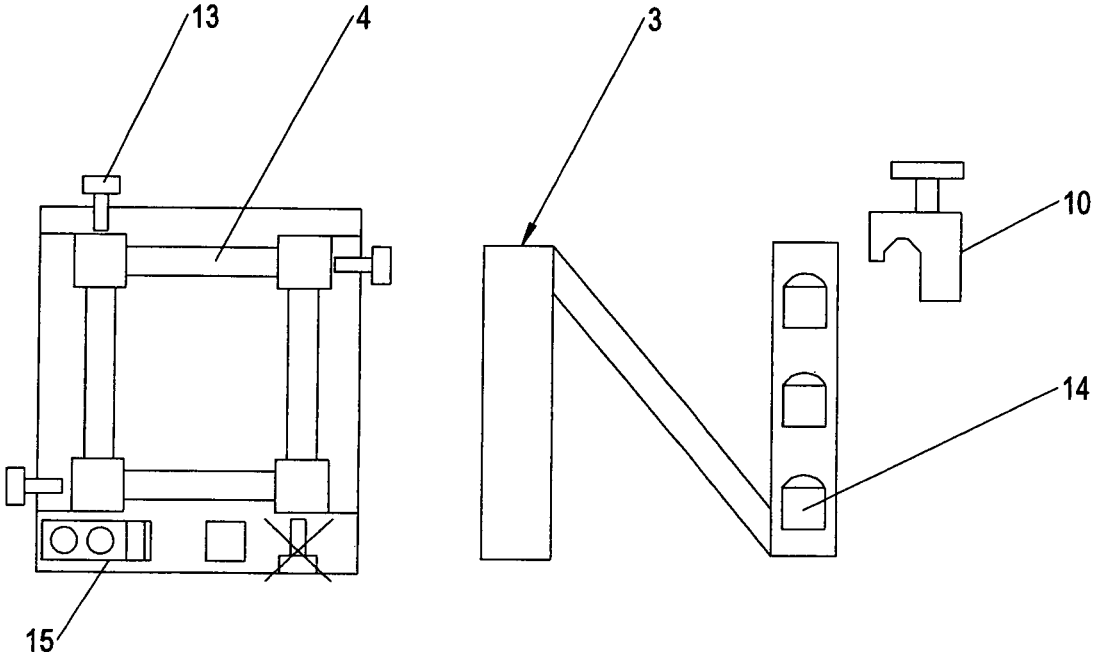
Figure 4:
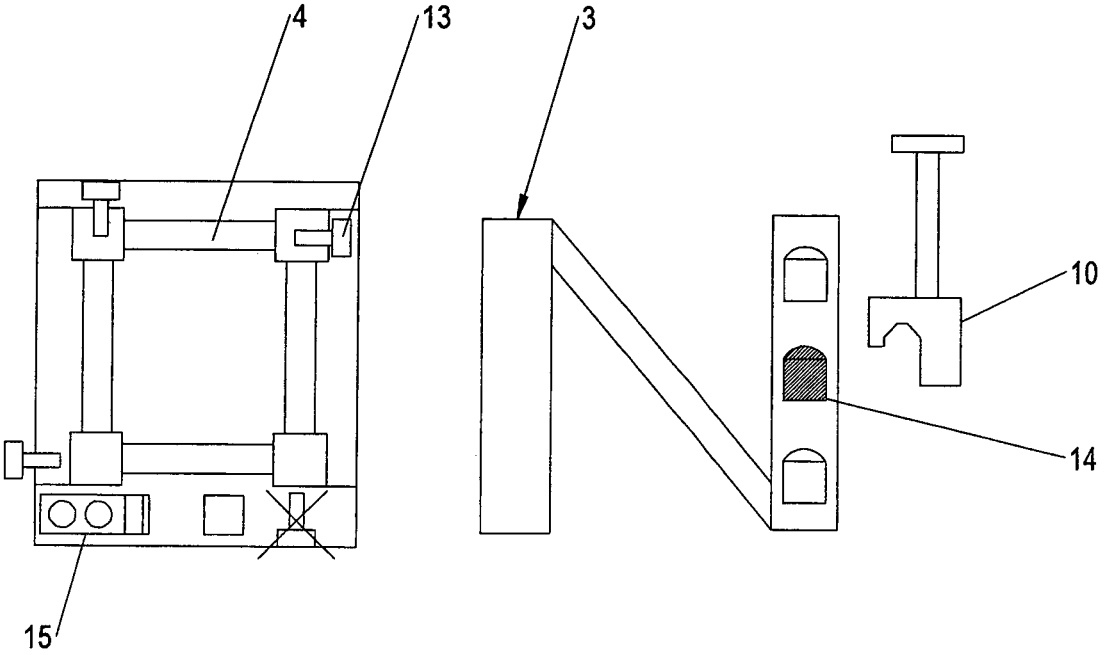

FIG. 4(*a*) shows a possible display of the display 8. Here, one schematically distinguishes a cross section of the tower structure 4 in an area where the climbing apparatus 2 surrounds the crane tower. Furthermore, one distinguishes the various states of the connection means 13 which are insertable in the counterparts provided to this effect. In the specific representation, the connection means 13 are studs which are insertable in their associated reception holes. None of the connection means 13 is in effective connection to the tower structure 4 as it is shown that the corresponding studs are not connected to the latter.

Furthermore, the state of the hoisting device 10 is represented by the graphic presentation 15. One distinguishes that the lifting cylinder of the hoisting device 1 is not in a deployed state.

Moreover, one distinguishes a representation of a mast section 3 showing several vertically stacked cleats 14 where the climbing apparatus can be supported. At the right side of the stylised mast section 3, the state of the hoisting device 10 which, in FIG. 10, corresponds to an inserted state, is also shown.

Essentially, FIG. 4(*b*) shows the same symbols as FIG. 4(*a*). Only their state was changed. Thus, the cross-section presentation of the tower structure 4 two connection means 13 are now connected to the tower. This represents an inserted stud. The middle one of the three stacked supporting cleats 14 is shown in a different colour. That means that the hoisting device 10 is connected to such supporting cleat and is supported by it. The state of the hub device as such is also shown in a changed way and by a deployed cylinder, by contrast to FIG. 4(*a*).

By means of such visualisation, an operator of the climbing system of the invention can gain an overview within a short period of time over any and all important parameters of the system. Any potential errors can also be detected quickly.

The invention claimed is:

1. A climbing system (1) for a crane, comprising:

a climbing apparatus (2) positioned for inserting a mast section (3) or for removing a mast section (3) between sections of a tower structure (4) of a crane, the climbing apparatus (2) connectable to a portion of the tower structure (4) extending above and below the climbing apparatus (2) and comprising devices (13) for connecting the mast section (3) to the tower structure (4), a control unit (5) coupled to the climbing apparatus (2) for controlling the climbing apparatus (2), and a first sensor (51) positioned proximate to each said connection device (13) for monitoring a state of the respective connection devices (13) of the climbing apparatus (2) and/or the tower structure (4), wherein the first sensor (51) is connected to the control unit (5).

2. The system (1) according to claim 1, wherein the control unit (5) comprises an interface (6) to be connected to a crane control of the crane such that the crane and the climbing apparatus (2) are controllable via a common control unit, preferably the control unit (5).

3. The system (1) according to claim 1, comprising a second sensor (52) for detecting a mark mounted on a guiding frame (7) of the climbing apparatus (2) or the tower structure (4) and enabling conclusion to specific properties of the tower structure (4), wherein the second sensor (52) is connected to the control unit (5).

4. The system (1) according to claim 3, wherein the guiding frame (7) surrounds the mast section (3) and the second sensor (52) is mounted upon the guiding frame (7) of the climbing apparatus (2).

5. The system (1) according to claim 1, comprising a third sensor (53) for monitoring a hoisting device (10) of the climbing apparatus (2), wherein the third sensor (52) is connected to the control unit (5).

6. The system (1) according to claim 5, additionally comprising a guiding frame (7) surrounding the mast section (3), wherein the third sensor (53) is mounted on the guiding frame (7).

7. The system (1) according to claim 1, comprising a fourth sensor (54) for detecting the orientation and the angle of slope of the climbing apparatus (2) and/or the crane, wherein the fourth sensor (54) is connected to the control unit (5).

8. The system (1) according to claim 7, additionally comprising a guiding frame (7) surrounding the mast section (3), wherein fourth sensors (54) are mounted on stiffeners at the top and bottom of the guiding frame (7).

9. The system (1) according to claim 1, comprising a fifth sensor (55) for the torque detection at least at one point of the climbing apparatus (2), wherein the fifth sensor (55) is connected to the control unit (5).

10. The system (1) according to claim 9, additionally comprising a guiding frame (7) surrounding the mast section (3), wherein the fifth sensor (55) is mounted on the guiding frame (7).

11. The system (1) according to claim 1, comprising a detection system for monitoring an area between the tower structure (4) and the climbing area (2) and an area where the mast section (3) is inserted in the tower structure (4) or is removed from the latter, wherein monitoring is preferably effected by a light grid, a laser, a haulage rope and/or a camera system.

12. The system (1) according to claim 1, wherein the control unit (5) is configured to trigger the climbing apparatus (2) and/or the crane such that an inserting process of the mast section (3) into the tower structure (4) or a removing process from the latter runs automatically.

13. The system (1) according to claim 12, comprising at least one device for coupling and uncoupling the respective connection devices (13) connected to the control unit (5) and controllable by the latter.

14. The system (1) according to claim 1, comprising optical display elements (8) for reproducing various states of the system (1) and preferably for displaying activities to be executed.

15. The system (1) according to claim 1, additionally comprising a hoisting device (10) positioned to lift a portion of the tower structure (4) arranged above the climbing apparatus (2) away from a portion of the tower structure (4) beneath the climbing apparatus (2), and a carrier drive (16) arranged to horizontally insert a mast section (3) into a gap between the separated portions of the tower structure (4) or remove the mast section therefrom.

16. The system (1) according to claim 1, wherein the connection devices (13) are studs arranged to be inserted into respective holes in the tower structure (4).

* * * * *